US007350349B2

(12) United States Patent
Olofsson

(10) Patent No.: US 7,350,349 B2
(45) Date of Patent: Apr. 1, 2008

(54) METHOD AND DEVICE OF A PARTICLE FILTER FOR AN EXHAUST SYSTEM, SILENCER INCLUDING SUCH A DEVICE, AND A COMBUSTION ENGINE DRIVEN VEHICLE

(75) Inventor: Klas Olofsson, Mariefred (SE)

(73) Assignee: Scania CV AB (publ) (SE)

( * ) Notice: Subject to any disclaimer, the term of this patent is extended or adjusted under 35 U.S.C. 154(b) by 0 days.

(21) Appl. No.: 10/552,794

(22) PCT Filed: Mar. 24, 2004

(86) PCT No.: PCT/SE2004/000445

§ 371 (c)(1),
(2), (4) Date: Oct. 11, 2005

(87) PCT Pub. No.: WO2004/090295

PCT Pub. Date: Oct. 21, 2004

(65) Prior Publication Data

US 2006/0191255 A1 Aug. 31, 2006

(30) Foreign Application Priority Data

Apr. 14, 2003 (SE) ..... 0301093

(51) Int. Cl.
*F01N 3/00* (2006.01)

(52) U.S. Cl. ..... 60/295; 60/274; 60/287; 60/288; 60/297; 60/324; 181/237; 181/258; 181/272

(58) Field of Classification Search ..... 60/274, 60/276, 287, 288, 296, 297, 311, 324; 55/DIG. 30; 181/212, 232, 237, 238, 258, 265, 272
See application file for complete search history.

(56) References Cited

U.S. PATENT DOCUMENTS

| | | | | |
|---|---|---|---|---|
| 3,712,030 | A * | 1/1973 | Priest | 96/118 |
| 3,841,841 | A * | 10/1974 | Torosian et al. | 422/115 |
| 4,916,897 | A * | 4/1990 | Hayashi et al. | 60/286 |
| 4,961,314 | A * | 10/1990 | Howe et al. | 60/288 |
| 5,009,065 | A * | 4/1991 | Howe et al. | 60/288 |
| 5,052,178 | A * | 10/1991 | Clerc et al. | 60/274 |
| 5,138,835 | A | 8/1992 | Bender et al. | 60/278 |

(Continued)

FOREIGN PATENT DOCUMENTS

EP 0 679 799 A2 11/1995

(Continued)

OTHER PUBLICATIONS

International Search Report PCT/SE2004/000445 dated Jun. 16, 2004.

*Primary Examiner*—Tu M. Nguyen
(74) *Attorney, Agent, or Firm*—Ostrolenk, Faber, Gerb & Soffen, LLP

(57) ABSTRACT

Method and device for a particle filter for an exhaust system for a combustion engine, wherein the filter is regenerated by spontaneous combustion of particles accumulated in the filter. Exhaust gases from the combustion engine are led, during operation, past the filter when the counterpressure in the exhaust gases which is caused by the filter exceeds a certain level. The invention also relates to a silencer in a vehicle which is driven by the combustion engine.

6 Claims, 2 Drawing Sheets

U.S. PATENT DOCUMENTS

| | | | | |
|---|---|---|---|---|
| 5,357,755 | A * | 10/1994 | Gillingham et al. | 60/288 |
| 6,588,203 | B2 * | 7/2003 | Hirota et al. | 60/297 |
| 6,662,554 | B2 * | 12/2003 | Sheidler et al. | 60/290 |
| 6,889,498 | B1 * | 5/2005 | Chandler et al. | 60/311 |
| 6,918,463 | B2 * | 7/2005 | Takahashi et al. | 181/237 |

FOREIGN PATENT DOCUMENTS

| | | |
|---|---|---|
| EP | 0 949 408 A1 | 10/1999 |
| GB | 1128661 | 10/1968 |
| WO | WO 03/074846 A1 | 9/2003 |

* cited by examiner

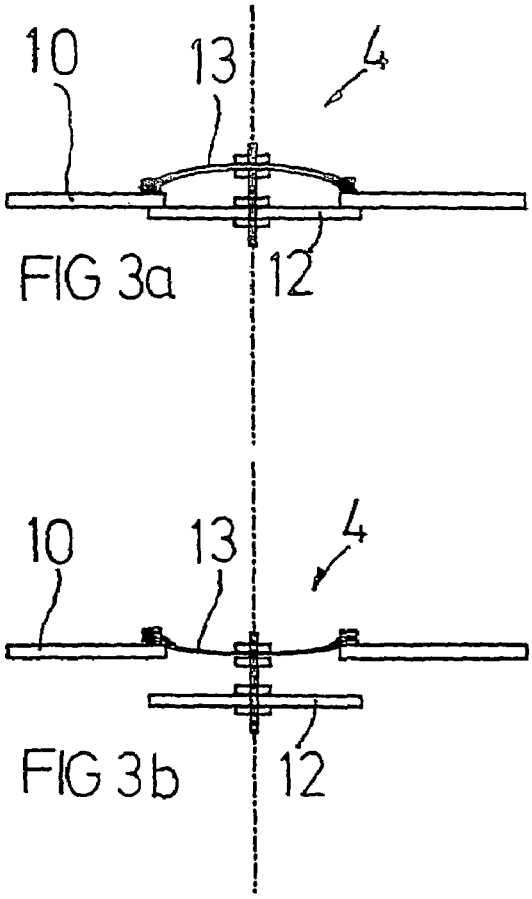
FIG 3a
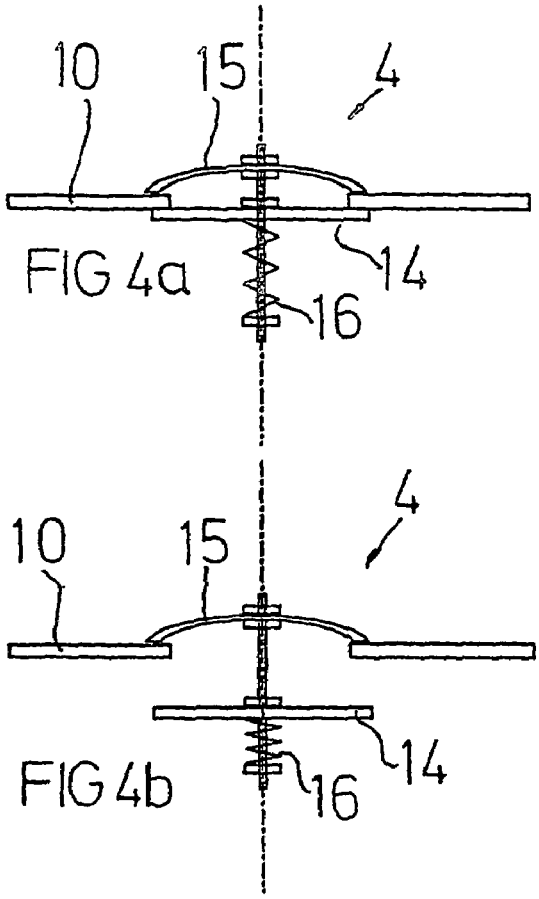
FIG 4a
FIG 3b
FIG 4b

METHOD AND DEVICE OF A PARTICLE FILTER FOR AN EXHAUST SYSTEM, SILENCER INCLUDING SUCH A DEVICE, AND A COMBUSTION ENGINE DRIVEN VEHICLE

CROSS REFERENCE TO RELATED APPLICATION

The present application is a 35 U.S.C. §§ 371 national phase conversion of PCT/SE2004/000445, filed 24 Mar. 2004, which claims priority of Swedish Application No. 0301093-1, filed 14 Apr. 2003. The PCT International Application was published in the English language.

TECHNICAL FIELD

The invention relates to a method pertaining to a particle filter according to the invention, a device pertaining to a particle filter, a silencer comprising such an arrangement for a vehicle powered by a combustion engine.

STATE OF THE ART

A known practice for reducing particle emissions from vehicles powered by combustion engine, particularly diesel-powered heavy vehicles, is post-treatment of exhaust gases from the engine with a view to reduction of particle content. This is done for example by particle filters comprising filter elements made of ceramic material. Such filters are typically regenerated spontaneously during operation of the vehicle by accumulated particles, mainly soot, being allowed to burn so that the filter is kept clean and can therefore continuously perform its filtering function.

In an ideal case, the burning clean takes place passively in such a way that $NO_2$ reacts with carbon in the particles gathered in the filter so as to form carbon dioxide and NO. This process works well within a limited temperature range and subject also to the $NO_2$/particle ratio not exceeding a certain value.

In most operating situations of diesel-driven heavy vehicles, there is some likelihood of the necessary regeneration conditions occurring during an operating period. However, if a vehicle equipped with a particle filter is driven in such a way as to operate for a long time outside the range within which the filter would be subject to the temperature required for the regeneration process, and/or if the $NO_2$/particle ratio is low, no regeneration takes place, which means that an excess of soot particles may accumulate in the filter.

The whole or at least part of the particle filter may then contain a supercritical amount of soot resulting in risk of the particle filter being damaged when the particles in the filter eventually ignite, since their combustion may either throughout or locally become uncontrolled, leading to excessively high temperatures.

Objects and Most Important Characteristics of the Invention

One object of the present invention is to eliminate or at least alleviate the problems of the state of the art and indicate a device for particle filters which increases the certainty of protecting filter devices against such damage.

This object is achieved according to the invention with a method of the kind mentioned in the introduction by the invention. Hence the accumulation in the filter of an excess of soot particles, which might result in damage to the filter from eventual ignition, is prevented.

According to the invention, when the filter has accumulated so many particles as to cause a certain predetermined counterpressure, exhaust gases are instead led past the filter so that the latter will receive a limited amount of particles before regeneration takes place, i.e. before the operating conditions become such as to cause spontaneous ignition and combustion of the particles.

As mentioned above, normal operation also sometimes includes operation resulting in low exhaust temperatures. This kind of operation may occur during no-load running, running lightly laden, running with additional equipment for heavy vehicles such as cranes, lifts etc. Long periods of such operating conditions with exhaust cleaning by particle filter according to the state of the art may result in the accumulation of soot particles in the filter becoming supercritical, with consequent risk of the aforesaid damage.

Another typical form of operation which is risky in this context is urban passenger bus operation whereby accelerations with associated smoke emissions from the engine result in a large amount of particles accumulating in the filter. The nature of such light-load operation results in obvious risk of insufficient frequency of combustion of the particles.

The invention provides a safe system based on the principle that the pressure drop across the particle filter and, analogously, the exhaust counterpressure upstream from the filter provides a description of how full of particles the filter is.

For the purposes of the invention, there is no need to lead the whole exhaust flow away from the filter, as it may be sufficient to divert past the filter one portion of the flow while a relatively smaller other portion of the exhaust gases continues to be allowed to pass through the filter. During such passing through there will of course also be a further, albeit smaller, accumulation of particles in the filter, typically resulting in an increasing proportion of the exhaust flow being led past the filter, given a certain volume of exhaust. Setting the means of bypassing the filter so that a suitable level of counterpressure/pressure drop causes bypassing can easily be achieved by simple experimentation.

Transitions from no-load or light-load running with associated low exhaust temperatures typically involve delays of the order one or a few minutes before the exhaust temperature brings the filter up to temperatures at which spontaneous regeneration takes place. A filter temperature of between 250 and 450° C. is typically regarded as suitable for the occurrence of spontaneous ignition and combustion of particles and hence regeneration of the filter.

Leading exhaust gases past the particle filter through a valve which opens when the exhaust counterpressure is above said level results in a simple and reliable system which is enhanced if the valve opens in response to exhaust pressure against the action of a holding-back spring. The result is a reliable automatic mechanical system which is easy to set for achieving a desired opening level.

A possibility not excluded, however, is the counterpressure being detected by a pressure sensor which provides output signals used by control devices for controlling the bypassing of the filter. In such cases a pressure sensor may be placed upstream from the filter. It is possible instead to place a pressure sensor upstream from the filter and a pressure sensor downstream from the filter so that the pressure drop across the filter can be detected. Bypassing can in practice be effected by a regulating device controlled by a computer unit so that all or part of the exhaust gases are switched.

It is preferable that the exhaust gases be led past the filter through a space within a silencer which encloses the filter. This means that the sound damping function of a silencer which comprises the filter can also be maintained during bypassing of the filter. It is in particular preferred that a catalyst, which is a filter connected in series, receives exhaust gases which are led past the filter. Such cases utilise the fact that $NO_2$ emitted from the catalyst takes part in the combustion process in the filter as indicated at the beginning of this description.

Corresponding advantages are achieved with a device, a silencer and a vehicle driven by combustion engine according to the invention.

BRIEF DESCRIPTION OF THE DRAWINGS

The invention will now be described in more detail on the basis of examples and with reference to the attached drawings, in which:

FIGS. 3*a* and 3*b* depict a valve arrangement according to a first embodiment in closed and open positions respectively, and FIGS. 4*a* and 4*b* depict a valve arrangement according to a second embodiment in closed and open positions respectively.

DESCRIPTION OF EMBODIMENTS

Figure 1:
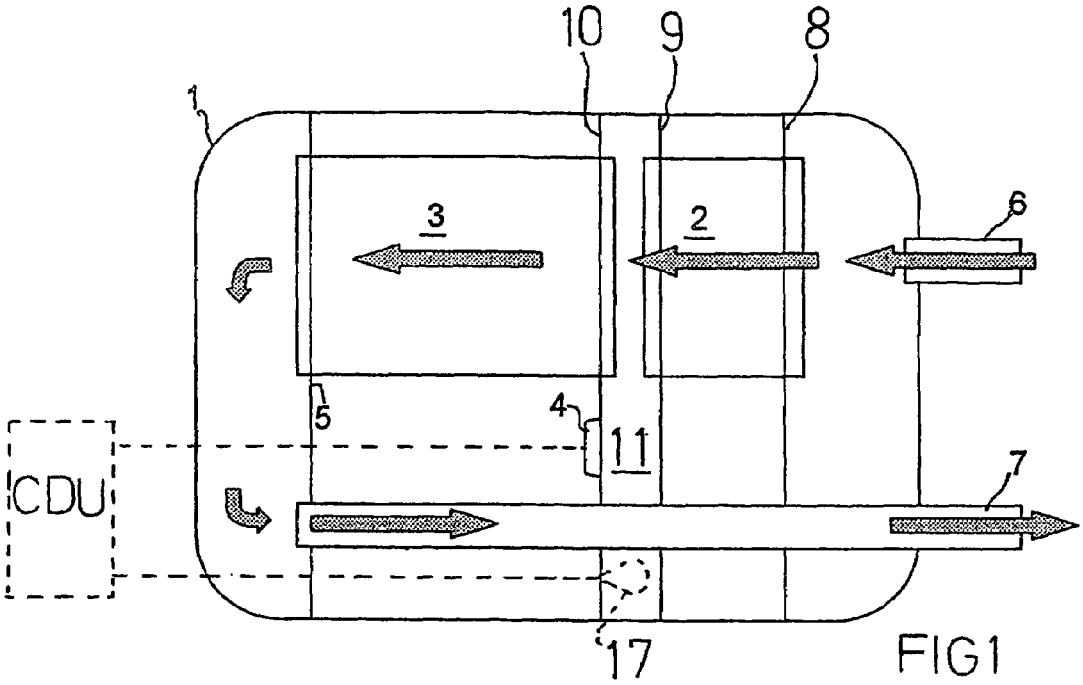
FIG. 1 depicts in schematic section a silencer for an engine-driven vehicle with a particle filter through which exhaust gases from the engine flow.

In FIG. 1, ref. 1 denotes a silencer for an exhaust system of a combustion engine, particularly a diesel engine for a heavy vehicle such as a bus or a truck. The silencer 1 encloses an integrated particle filter 3 fitted at a distance from a catalyst 2 such that in normal operation the catalyst 2 and the particle filter 3 are arranged in series. Exhaust gases flowing from the combustion engine through the silencer inlet 6 thus pass through both the catalyst 2 and the particle filter 3 before going through the outlet pipe 7 and on through the exhaust system to the environment.

The silencer 1 comprises two transverse walls 8 and 9 which support the catalyst 2 and are arranged sealingly with respect both to the inside of the silencer and the outer surface of the housing of the catalyst 2. A further transverse wall 10 is arranged for fastening the particle filter 3 on its upstream side and is sealingly arranged with respect to the inside of the silencer and the housing of the particle filter. In this transverse wall 10 is arranged a valve 4 which is closed in the position depicted in FIG. 1 so that exhaust gases from the catalyst 2 which fill the space 11 between the transverse walls 9 and 10 can only pass through the silencer by passing through the particle filter 3. A transverse wall 5 with at least one undepicted hole in it is so situated as to hold in place in the silencer 1 the downstream portion of the particle filter.

Figure 2:
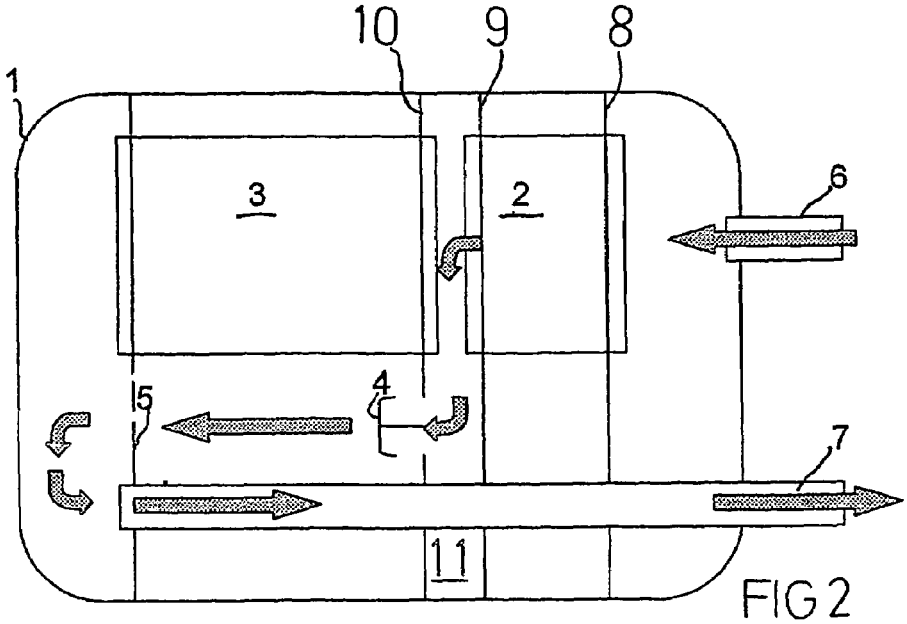
FIG. 2 depicts the silencer in FIG. 1 with exhaust gases bypassing the filter.

FIG. 2 depicts a situation in which the exhaust gases flowing through the inlet 6 and through the catalyst 2 meet such a powerful counterpressure in the particle filter 3 that the pressure in the space 11 between the transverse walls 9 and 10 increases. The result is that the valve 4, which is spring-loaded, lifts from its seat and allows exhaust gases to flow from the space 11 past the particle filter 3, through the perforated wall 5 and on through the outlet 7 to the environment. This flow path occurs, e.g. during light load, when so many particles have accumulated in the filter 3 that the counterpressure exceeds a certain level. This flow path will continue until greater load causes the exhaust gases to become so hot that the filter reaches a temperature at which spontaneous regeneration takes place. Thereafter the flow of exhaust gases will revert to the flow path depicted in FIG. 1.

FIG. 3*a* depicts an example of a version of the valve 4 in the form of a mechanically simple self-controlling element. In FIG. 3*a*, the valve 4 is in a closed position with a valve element 12 abutting sealingly against the intermediate wall 10 in order to seal a hole. On the upstream side of the intermediate wall 10 is arranged a snap spring 13 which holds back a gas pressure on the upper side (in the drawing) of the intermediate wall 10. At a gas pressure exceeding a certain level, this snap spring snaps to the valve open position as depicted in FIG. 3*b*, thereby opening a flow passage through the intermediate wall 10 past the valvepiece 12.

FIG. 4*a* depicts an alternative design of the valve 4 with a holding-back yoke 15 and a helical spring 16 which presses the valvepiece 4 against the intermediate wall 10 in order to seal a hole in said intermediate wall. A gas pressure exceeding a certain level on the upper side of the intermediate wall 10 in FIGS. 4*a* and 4*b* will cause the valvepiece 14 to open a flow passage through said hole in the intermediate wall 10 by downward movement of the valvepiece 14 against the action of the force exerted by the helical spring 16.

The invention may be varied within the scopes of the ensuing claims. Thus the bypassing of the particle filter may be effected in a different manner, as indicated by broken lines in FIG. 1, e.g. by placing upstream from the particle filter a pressure sensor 17 whose output signals are led to a control unit (CDU) which causes bypassing of the particle filter by means of an undepicted regulating device.

The particle filter may also be arranged separately, i.e. not integrated in a silencer nor associated with a catalyst, although the version depicted in FIGS. 1 and 2 is in principle preferred, particularly with a silencer in which both a catalyst and a particle filter are integrated.

It is preferred that exhaust gases be always allowed to pass through the catalyst even when the particle filter is bypassed, but this is not necessary for the invention.

If sensors are used for measuring counterpressure or pressure drop across the particle filter, a control system which reacts to signals from said sensors may also take into account signals from the engine which describe the exhaust flow, i.e. engine speed, accelerator position etc., in order to achieve more exact values and levels at which the particle filter should be bypassed.

The invention claimed is:

1. In an exhaust system of a combustion engine including a particle filter and a silencer which encloses the filter; a method for regenerating the filter by spontaneous combustion of particles accumulated in the filter, the method comprising:

leading the exhaust gases from the combustion engine in operation through the filter, or leading the exhaust gases from the combustion engine in operation to bypass past the filter and through a space inside the silencer, wherein said space surrounds the filter, when a counterpressure in the exhaust gases which is caused by the filter exceeds a set level;

passing the exhaust gases through a catalyst including during bypassing of the filter; and leading the exhaust gases from the combustion engine past the filter through a valve, located after said catalyst, and opening the valve when the counterpressure in the exhaust gases is above the set level.

2. A method according to claim 1, wherein the valve is operable to open because of the action of the pressure of the exhaust gases against a holding-back spring.

3. A method according to claim 1, further comprising detecting the counterpressure by at least one pressure sensor and using output signals from the sensor for controlling (CDU) the bypassing of the filter.

4. Apparatus for containing a particle filter for an exhaust system of a combustion engine comprising:

the filter is adapted to being regenerated by spontaneous combustion of particles accumulated in the filter, a silencer which encloses the filter;

a bypass duct via which exhaust gases from the combustion engine in operation are arranged to be led to bypass past the filter when a counterpressure in the exhaust gases which is caused by the filter exceeds a set level, and the duct leading the exhaust gases past the filter through a space inside the silencer, the space surrounding the filter;

a catalyst and a device operable for causing the exhaust gases to pass through the catalyst during bypassing of the filter; and a valve, located after said catalyst along a path of the exhaust gases, the valve is operable to open when the counterpressure in the exhaust gases is above the set level, for leading exhaust gases from the combustion engine past the filter.

5. The apparatus according to claim 4, further comprising a holding-back spring in the valve against which the pressure of the exhaust gases acts.

6. The apparatus according to claim 4, further comprising at least one pressure sensor for detecting the counterpressure, the sensor produces output signals which are operable for controlling (CDU) the bypassing of the filter.

* * * * *